United States Patent [19]

Maguire

[11] 4,245,416

[45] Jan. 20, 1981

[54] PICTURE MOUNT

[75] Inventor: Frederick J. Maguire, Braintree, Mass.

[73] Assignee: Charles D. Burnes Company, Boston, Mass.

[21] Appl. No.: 958,191

[22] Filed: Nov. 6, 1978

[51] Int. Cl.[3] ..... G09F 1/12

[52] U.S. Cl. ..... 40/152.1; 40/124.1

[58] Field of Search ..... 40/152.1, 152, 156, 40/154, 155, 153, 158 R, 159, 158 B, 124.1, 124.2, 10 R

[56] References Cited

U.S. PATENT DOCUMENTS

| | | | |
|---|---|---|---|
| 1,225,195 | 5/1917 | Wanda | 40/152 |
| 2,247,150 | 6/1941 | Chilcote | 40/152.1 X |
| 2,292,744 | 8/1942 | Cross | 40/152.1 |
| 2,377,487 | 6/1945 | Fox | 40/152.1 |
| 2,816,382 | 12/1957 | Spertus | 40/152.1 |
| 2,845,732 | 8/1958 | Nichols | 40/152.1 X |
| 3,360,227 | 12/1967 | Overton et al. | 40/152.1 X |
| 3,837,987 | 9/1974 | Williams et al. | 40/152.1 |

*Primary Examiner*—John F. Pitrelli

*Attorney, Agent, or Firm*—Charles E. Pfund

[57] ABSTRACT

A molded picture mount comprising a rigid frame defining a window opening of predetermined configuration, a support attached to the back of the frame defining a pocket behind the window opening closed at the bottom and sides and open at the top and a leg hingedly connected at one end to the back side of the support for supporting the mount in an upright, rearwardly-inclined position.

2 Claims, 9 Drawing Figures

PICTURE MOUNT

BACKGROUND OF INVENTION

Picture mounts are, for the most part, made of several plies of flat sheet paperboard cut to shape, assembled in predetermined relation and wrapped. This is done partly with die-cutting and gluing machinery and partly by hand. Such mounts are inexpensive, but because of the sheet material of which they are comprised, are generally flat and without character, except as imparted thereby by embossing or of texturizing the wrapping. It is the purpose of this invention to provide picture mounts which are comprised of a minimum number of component parts, which require very little assembly and especially mounts provided with one-piece molded frames which are distinctively three-dimensional in appearance. Further objects are to provide picture mounts wherein the frames are molded of plastic to the desired configuration and decorated by conventional molding procedures and the supports are comprised of paperboard and adapted to be applied as units to the back sides of the frame by adhesive.

SUMMARY OF INVENTION

As herein illustrated, the picture mount comprises a rigid frame defining a window opening of predetermined configuration, a support attached to the back side of the frame defining a pocket behind the window opening which is closed at the bottom and sides and open at the top for receiving through the open top a picture for display through said window opening and a leg member hingedly connected at one end to the rear side of the support for supporting the mount comprising the frame and support in an upright, rearwardly-inclined position. The frame has a planar back side and the support comprises in the form of a unit a back board substantially coextensive in breadth and length with the frame and spacers marginally of the bottom and sides disposed between it and the planar surface of the frame. The spacers are narrower than the portions of the frame bounding the window opening and comprise a U-shaped part, the base of which is hingedly connected to the lower edge of the back board and the legs of which extend along the opposite sides of the back board and are riveted at their ends thereto. The pocket thus formed is of sufficient depth perpendicular to the planar back surface of the frame to receive a windowpane as well as a picture. The frame is comprised of molded plastic of suitable rigidity and surface finish and the support is comprised of paperboard which may or may not be wrapped.

The invention will now be described in greater detail with reference to the accompanying drawings, wherein.

Figure 1:
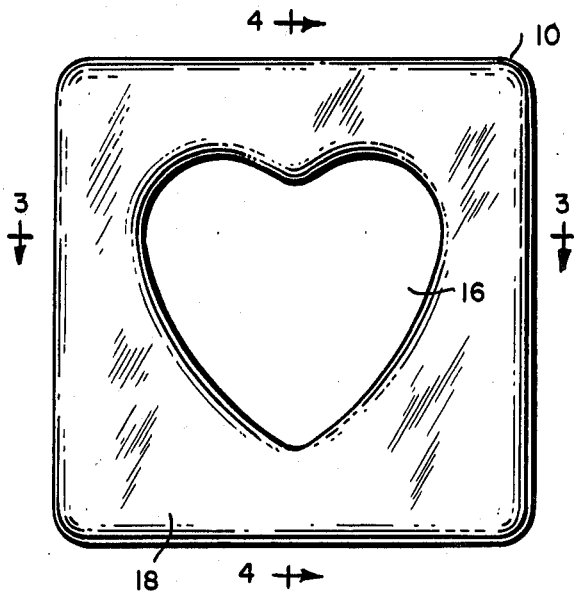
FIG. 1 is a front elevation of the picture mounting of this invention.
Figure 2:
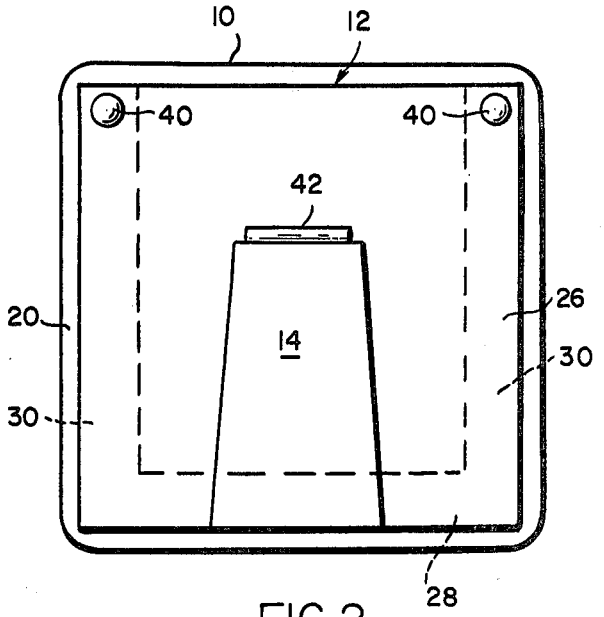
FIG. 2 is an elevation taken from the rear side of FIG. 1.

Referring to the drawings, FIG. 2, the picture mount comprises a rigid frame 10 to the back side of which is secured a support 12 to which is hingedly attached a leg 14.

The frame 10 is comprised of plastic, contains a window opening 16 of predetermined configuration, a generally planar front surface 18 marginally of window opening which may be appropriately surface-finished and decorated and a back planar surface 20. The frame is of sufficient front-to-back thickness so that the peripheral edges defining the window opening 16 and the peripheral edges defining the frame can be readily molded to have a rolled finish at the edges which imparts a distinctively three-dimensional appearance to the frame.

Figure 3:
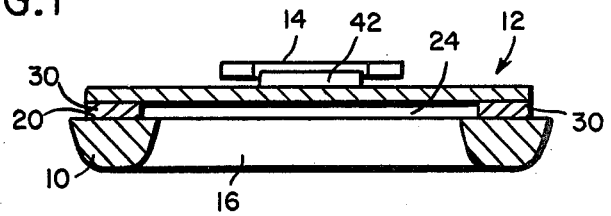
FIG. 3 is a horizontal section taken on the line 3—3 of FIG. 1.
Figure 4:
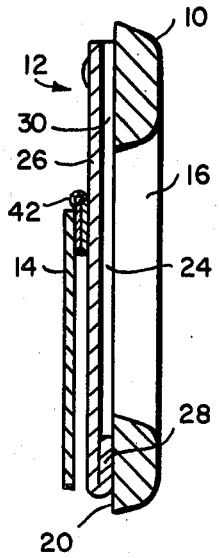
FIG. 4 is a vertical section taken on the line 4—4 of FIG. 1.
Figure 5:
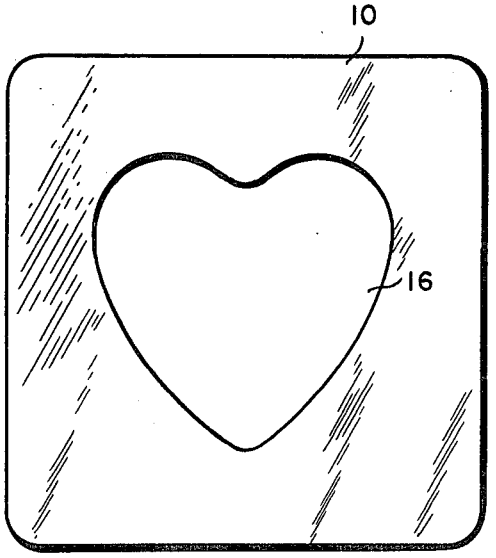
FIG. 5 is a plan view of the back side of the frame.
Figure 7:
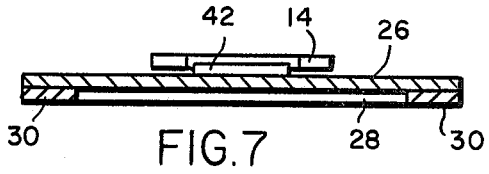
FIG. 7 is a horizontal section taken on the line 7—7 of FIG. 6.
Figure 6:
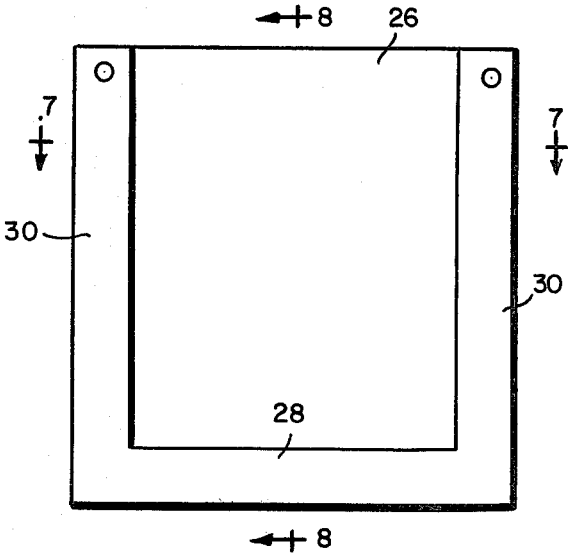
FIG. 6 is a plan view of the front side of the support.
Figure 8:
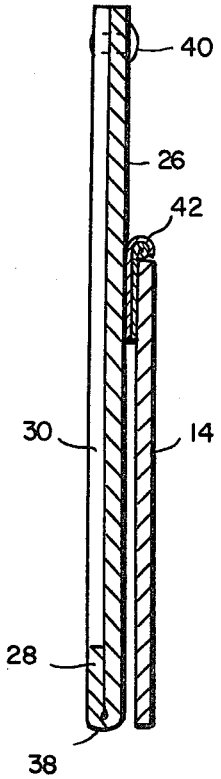
FIG. 8 is a vertical section taken on the line 8—8 of FIG. 6.

The support 12, FIGS. 6, 7 and 8, which, as stated, is attached to the planar surface 20 at the rear side of the frame, defines a pocket 24, FIGS. 3 and 4, behind the window opening 16 for receiving a picture and is sufficiently deep perpendicular to the plane of the planar surface at the rear side of the frame to also receive a pane of glass. The support 12 as shown in FIG. 6 is comprised of a back panel 26 which is substantially coextensive in breadth and depth to the frame and spacers 28 and 30—30 which extend, respectively, transversely of the lower end of the back board 26 and longitudinally of the opposite edges of the back board 26. The spacers hold the back board spaced from the rear side of the frame and define the bottom and sides of the pocket which is open at the top so as to enable readily sliding a picture and/or a pane of glass into a position between the back board and the frame behind the window opening.

Figure 9:
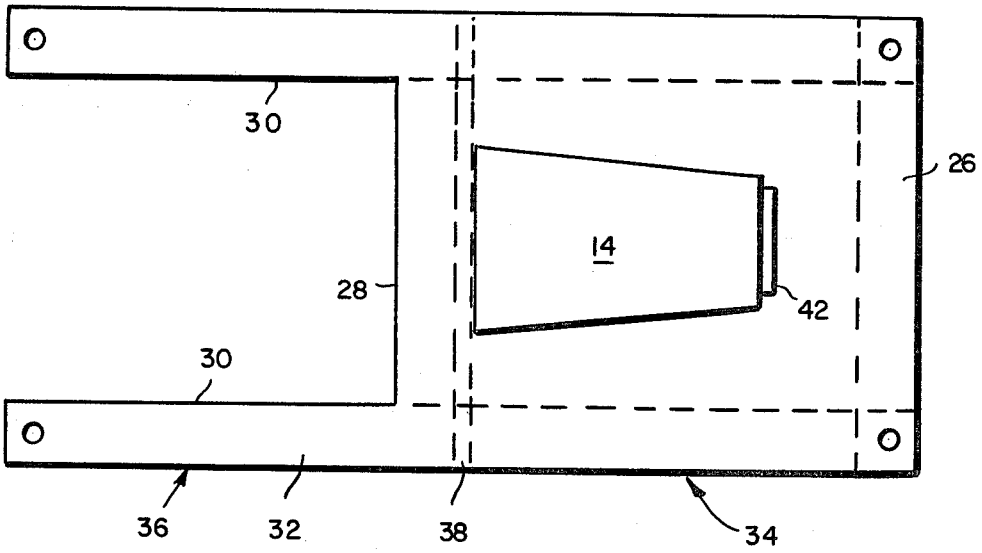
FIG. 9 is a plan view of the blank of which the support is comprised.

The support 12, as shown in FIG. 9, is comprised of two pieces of stiff paperboard 32,34 rigidly connected at 38 by an overwrapping of paper 36 so as to provide at one side of the hinge 38 the backboard 26 and at the other side the spacers 28 and 30—30. The pieces of paperboard 33,34 are folded on the hinge 38 and the ends of the spacers 30—30 are riveted to the back board by rivets 40—40. The folded support is then cemented to the rear side of the frame with the spacers between the back board and the frame.

The leg 14 is tapered and is hingedly connected by means of a leaf hinge 42 to the rear side of the back board 26 a little above the center of the back board so that it can be swung rearwardly from the back board to support the mount in an upright, rearwardly-inclined position. Desirably, the leaves of the hinge 42 are attached, respectively, to the rear side of the back board and the forward side of the leg so as to be substantially concealed between the back board and the leg.

The mount as thus described is of extremely simple construction, provides for a variety of design distinctiveness and is inexpensive to manufacture.

It should be understood that the present disclosure is for the purpose of illustration only and includes all modifications or improvements which fall within the scope of the appended claims.

I claim:

1. A picture mount comprising a rigid frame defining a window opening of predetermined configuration, said frame comprising a unitary molding of plastic structured to have a planar back side surface and a front side surface comprising a planar portion parallel to the plane of the planar back side surface and curved surfaces defining the outer peripheral edge of the frame and the inner peripheral edge bounding the window opening, a U-shaped spacer adhesively attached to said back side surface comprising a part extending along the bottom of the frame and parts extending along the two opposite sides of the frame, but open at the top side, said spacer being narrower in width than the back side of the frame and so positioned that the inner and outer edges of the spacer are spaced from and parallel to the outer edge of the frame and the edge of the window opening, a back board coextensive in area with the outside dimensions of the spacer such that the edges of the frame extend beyond the edges of the spacer and back board and thus conceal the same, hinge means attaching one end of the back board to the portion of the spacer extending along the bottom, said hinge means comprising a flexible sheet of paper adhesively attached to the spacer and back board and bridging the parallel coinciding edges of the spacer and back board at the bottom, rivets connecting the distal ends of the parts of the spacer extending along the sides to the upper end of the back board, said spacer and back board defining in conjunction with the planar back side surface of the frame a pocket behind the window opening of larger area than said window opening for receiving a picture and, optionally, a transparent window element, the front to back depth of the molded frame, to wit, the thickness of the frame perpendicular to its planar back surface exceeding the combined thickness of the back board and spacer, and a tapered leg, and a leaf hinge connecting the narrow end of the leg to the back board, said hinge being disposed between the back board and the leg so as to be substantially concealed.

2. A picture mount according to claim 1 wherein the frame is comprised of plastic.

* * * * *